United States Patent [19]

Viani

[11] Patent Number: 4,893,401

[45] Date of Patent: Jan. 16, 1990

[54] AUTOMATIC TRANSFORMER CORE ASSEMBLY SYSTEM

[75] Inventor: Ioseph Viani, Pomezia, Italy

[73] Assignee: Ansaldo Componenti S.p.A., Genoa, Italy

[21] Appl. No.: 255,158

[22] Filed: Oct. 7, 1988

[51] Int. Cl.[4] ..... H01F 41/02

[52] U.S. Cl. ..... 29/738; 29/609; 29/822; 414/793; 414/791.6

[58] Field of Search ..... 29/738, 609, 430, 469, 29/822; 414/57-59, 32-34; 156/560, 562, 572

[56] References Cited

U.S. PATENT DOCUMENTS 3,927,454 12/1975 Kobayashi et al. ..... 29/738
4,578,860 4/1986 Tanaka ..... 29/738

FOREIGN PATENT DOCUMENTS 0040810 3/1983 Japan ..... 29/738

*Primary Examiner*—Carl E. Hall
*Attorney, Agent, or Firm*—Emmanuel J. Lobato; Robert E. Burns

[57] ABSTRACT

An automatic assembly system for assembly of transformer laminated cores of the type having three parallel legs and two yokes. The laminations are stacked in a simple or complex configuration on a movable support frame on tracks, which receives the core laminations at a lamination loading station from four movable platforms on independent tracks. The platforms are grouped circumferentially about the support frame at four lamination feed positions while it is at the lamination loading station and have thereon stacked corresponding core laminations that are to be stacked on the support frame in a proper sequence and position order for forming a transformer laminated core. The system has four travelling gantry cranes that are on independent tracks and are each provided with a pick-up frame having suction cups arranged thereon for lifting the laminations individually from corresponding platforms at the four lamination feed positions and depositing them on the support frame in a properly stacked relationship. The individual cranes have the pick-up frame thereof movable laterally horizontally on trolleys on the individual cranes so that the laminations can be deposited in the core complex figuration. The support frame is cyclically movable form the lamination loading station to a remote station for removal of a completed transformer core therefrom and is then returned to the lamination loading station for forming of a next transformer laminated core thereon. The movable platforms are cyclically moved from their lamination feed positions to individual lamination loading positions where they are loaded with corresponding lamination and returned to their corresponding lamination feed positions for successively forming the individual transformer laminated cores.

8 Claims, 5 Drawing Sheets

AUTOMATIC TRANSFORMER CORE ASSEMBLY SYSTEM

BACKGROUND OF THE INVENTION

It is well-known that transformer cores consist of laminations placed one on top of the other, divided up into layers which are suitably staggered so that the lines of the joints never fall on the same plane. This invention refers in particular to an automatic assembling machine capable of setting up transformer cores of the type with three columns, that is to say with a left column 1 on one side, a right column 2 on the other side, a central column 3, a lower yoke 4 and an upper yoke 5 (see FIG. 1).

Naturally definitions "right", "central", "left", "upper" and "lower" are used only for the purpose of simplifying the following description.

FIG. 1 illustrates schematically a plan of this type of transformer core.

In setting up the core of a transformer, the upper yoke is fitted in a subsequent stage, and therefore the automatic assembly system according to this invention refers only to the assembly of the laminations forming the three columns and of the lower yoke.

As shown in FIG. 2, each element of the core, whether yoke or column, is made up of several steps (11 in the figure), always an uneven number, numbered here for reference purposes from G1 to G11, in such a way that the transverse section of each element of the core may be inscribed approximately within a circumference.

Obviously the central step G6 is thicker, while the remaining steps are arranged symmetrically on each side of this central step.

Each step is made up of several layers of identical laminations, the number of which is generally comprised between 2 and 4.

The succession of the various layers forming the core can be arranged in two different ways, known as "simple superimposition" and "complex superimposition".

FIG. 3 shows the simple superimposition pattern: the continuous lines indicate the positions of the identical and superimposed laminations of the i-th layer; the dotted lines indicate the positions of the identical and superimposed laminations of the $(i-1)$-th and $(i+1)$-th layers.

In this configuration the laminations of each successive layer occupy alternately one or the other of the two positions shown.

FIG. 4 illustrates the complex superimposition pattern: the continuous lines on the ends of the columns and of the lower yoke, and in the central area of the lower yoke indicate the positions of the laminations of the central layer; the dotted lines, on the otherhand, indicate the positions of the layers overlying and underlying said central layer, the ends of which are cut asymmetrically, staggered between pre-established minimum and maximum values.

The laminations in the side columns and in the bottom yoke for each single step are all identical to one another but, layer by layer, they are assembled staggered in a longitudinal direction.

The laminations of one and the same step of the central column are identical, but they are assembled in the opposite position, with the layers arranged symmetrically in relation to the central layer.

The laminations forming the core are made from grain-oriented silicon steel sheeting of a suitable thickness, usually between 0.2 and 0.4 mm.

The laminations are obtained from these sheets by blanking, after which they are packed on metal platforms in reverse order as compared to the sequence in which they will have to be piled for forming the various elements of the core (see FIGS. 5 to 7). From the platforms 7, 8 and 9, the laminations are taken to a suitable supporting frame 10, which has uprights 11, 12 and 13 and cross-members 14 and 15 reproducing the shape of the transformer core.

Indeed, the laminations of columns 1, 2 and 3 have to be transferred onto the uprights 11, 12 and 13, while the laminations of the yokes 4 and 5 have to be transferred onto the cross-members 14 and 15.

The supporting frame 10 must be suitably shaped and sufficiently strong to allow the operations to which the transformer core must be subjected after correct piling of the laminations.

BRIEF SUMMARY OF THE INVENTION

The assembly system according to the invention has the purpose of correctly piling up the core laminations, in an automatic manner, starting from platforms 7 to 9, which must be arranged around the supporting frame 10. The supporting platforms can be moved, for example on rails, from the place of loading of the laminations in the reverse order mentioned above, to their respective positions around the supporting frame of the core which is being built up.

After having been emptied due to the building up of the core on the supporting frame, the platforms shall be returned to their loading area ready for formation of another core and in order to free the area surrounding the supporting frame which is now loaded with all the core laminations except those of the upper yoke.

At this point the supporting frame has to be moved along to another station where it is tilted into a vertical position so that the transformer can be completed.

According to the invention, four separate overhead traveling cranes are used to load the various core laminations in consecutive stages from the various platforms onto the supporting frame.

These overhead traveling cranes are arranged in a ring around the supporting-frame loading station and may be backed away sufficiently to allow said frame to move freely as far as the tilting station and back.

This ring-type arrangement of the four overhead traveling cranes allows each of them to operate in a continuous sequence. It is simply necessary for each of these operating sequences to be staggered so that the two phases of lowering a frame supporting a lamination and of lifting the empty frame are alternated without interruption.

The next two stages will be identical, but will concern a different crane.

In this way different laminations will be deposited on the supporting frame, continuously.

Naturally the movements of the four overhead traveling cranes must be programmed so as to take into account the different staggering of each single lamination depending on the chosen configuration.

In this way a high transformer core build-up speed is achieved, with no waiting times for the single overhead traveling cranes. In this way the cost of the system is justified by its high productivity rate.

DESCRIPTION OF THE PREFERRED EMBODIMENT

FIGS. 1 to 8 have already been illustrated in the introductory part of the description, and same will therefore be discussed by way of reference only.

Figure 9:
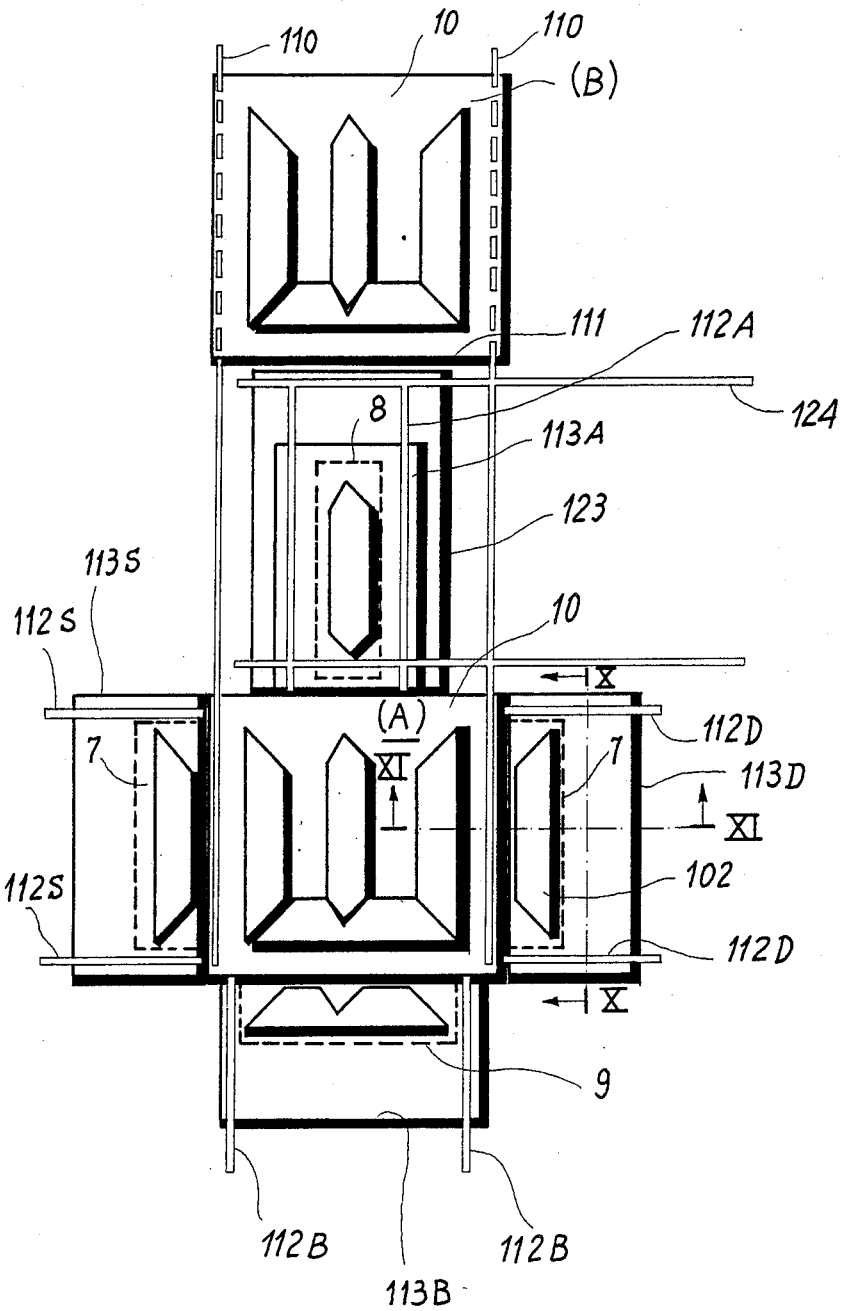
FIG. 9 is a plan showing the arrangement of the four overhead traveling cranes according to the invention, with the loading stations and the station for tilting the supporting frame.

In FIG. 9, a plan view of the supporting frame 10 of the transformer core being built up is visible; said supporting frame moves on rails 110 between a loading station (A) and a transformer-core tilting station (B). At the loading station (A) the supporting frame 10 is in a horizontal position, and the various core laminations are deposited on it in consecutive stages. Once piling up of the core laminations has been completed, the supporting frame 10 is shifted along the guiding rails 110 from the loading station (A) to the tilting station (B).

In FIG. 9 the frame 10 is illustrated at the tilting station (B) still in a horizontal position; in a subsequent stage, not illustrated here and with which this invention is not concerned, the supporting frame 10 is tilted over into a vertical position by rotating it on its lower edge 111 using suitable equipment.

The rails 110 must extend sufficiently to allow the frame 10 to be moved from station (A) to station (B) and vice versa.

To the left and to the right, with reference to FIG. 9, of the loading station (A), there are two pairs of guiding rails 112/S and 112/D, which end in front of the rails 110 of the supporting frame 10, without crossing them.

Two symmetrical overhead traveling cranes 113/S and 113/D used to build up the right and left columns of the transformer core at station (A) move along these rails 112/S and 112/D.

Figure 10:
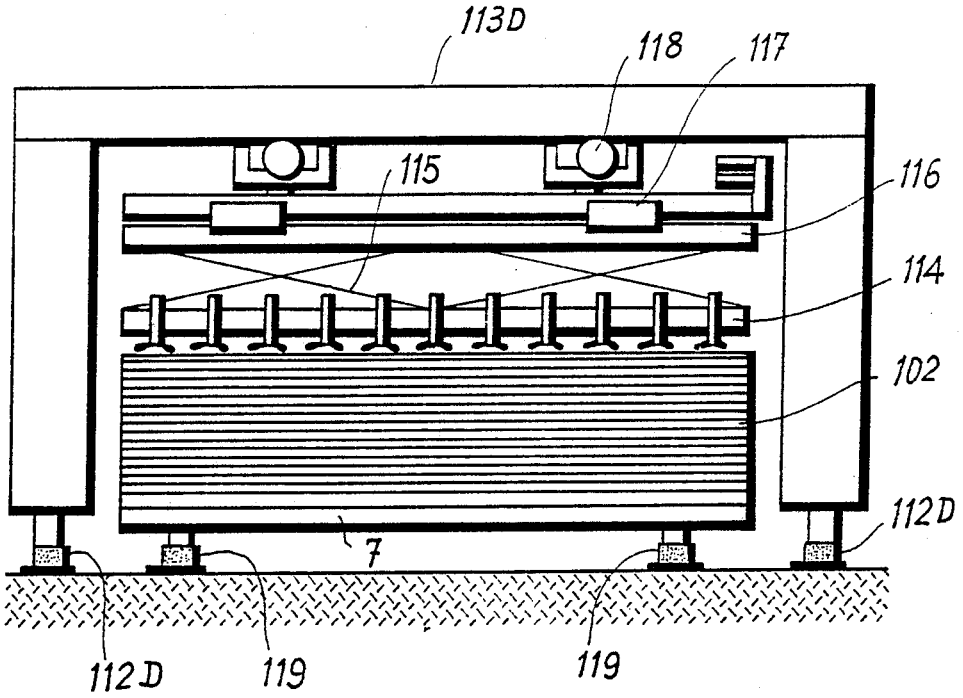
FIG. 10 shows a section of one of said four overhead traveling cranes, for example on X—X, of FIG. 9.
Figure 11:
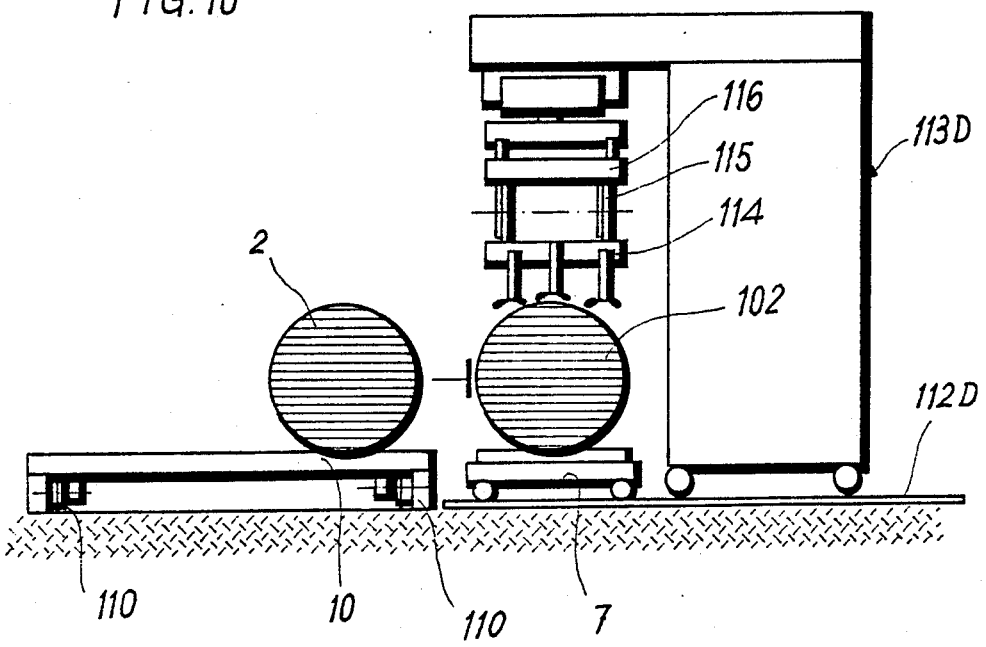
FIG. 11 is a section on XI—XI of FIG. 9.

With particular reference to FIGS. 9, 10 and 11, it can be seen that overhead traveling crane 113/D is a gantry crane moving along rails 112/D having a frame 114 equipped with suction cups, and which is capable of vertical movement actuated by scissor-jointed arms 115, which are supported in turn by a frame 116 which does not move vertically.

By means of suitable trolleys 117 and 118, the frame 116 is both transversally and longitudinally mobile and this diagonally in respect of the gantry crane 113/D.

The constructional solution schematically illustrated in FIGS. 10 and 11 may be taken as indicative only. The important point to note is that the overhead traveling crane 113/D must move along the rails 112/D perpendicularly to the rails 110, to bring the laminations of the right column from the platform 7 as far as the supporting frame 10 located at station (A).

This transverse movement, as referred to FIG. 9, must be accompanied by a vertical movement for lifting each single lamination from the piling platform 7 and lowering it over the frame 10.

Figure 1:
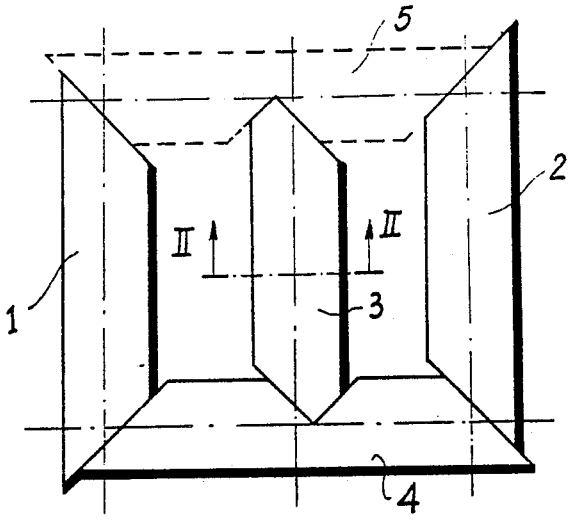
FIG. 1 is the plan of the layout of the core of a transformer with three columns and two yokes.
Figure 2:
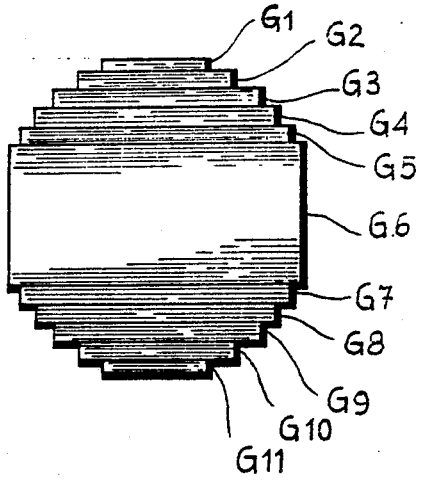
FIG. 2 shows a cross-section on II—II of FIG. 1 above, on a larger scale.
Figure 3:
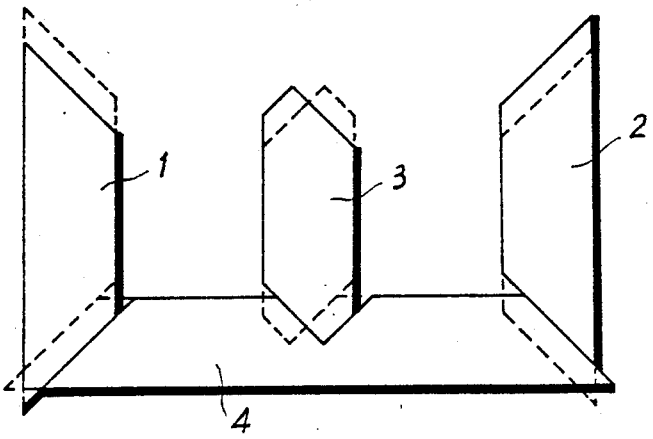
FIG. 3 shows how the transformer core laminations are superimposed upon one another according to the "simple superimposition" arrangement.
Figure 4:
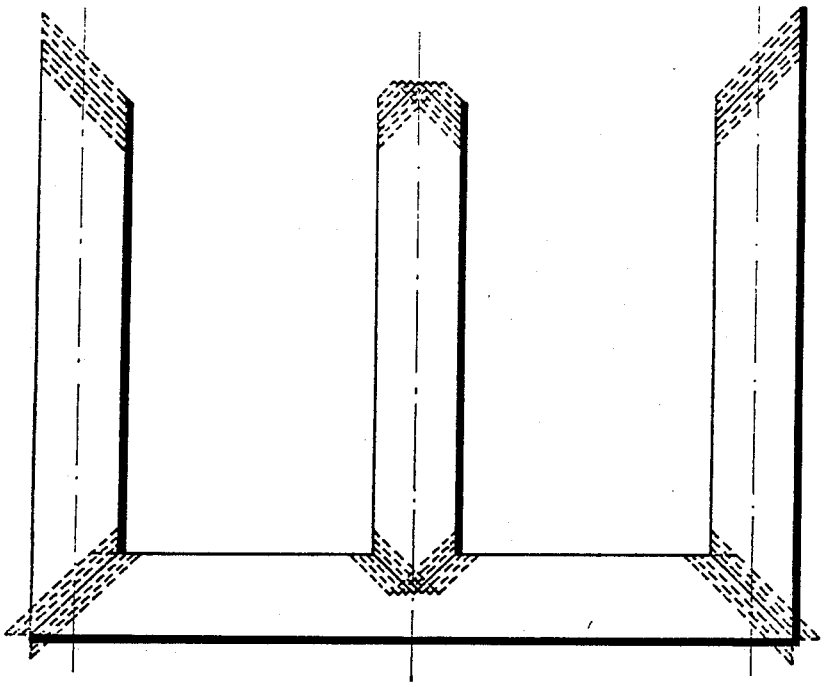
FIG. 4 is similar to the previous figure but refers to the "complex superimposition" arrangement.
Figure 8:
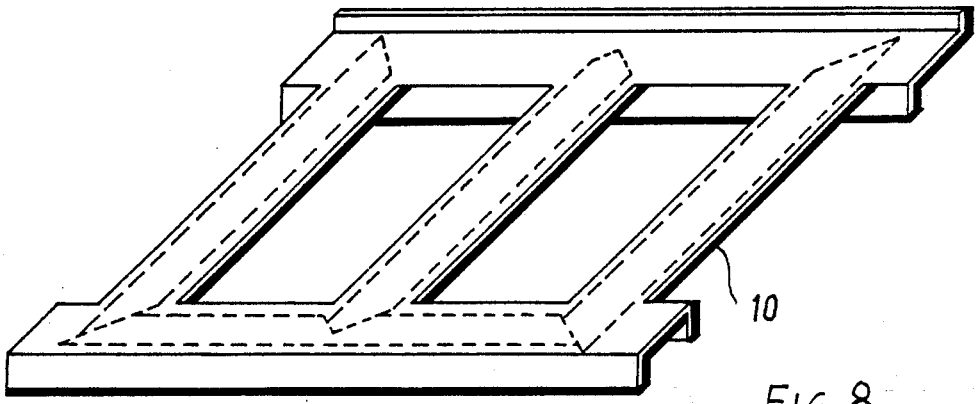
FIG. 8 is a schematic illustration of the supporting frame for the transformer core laminations, and which must be sufficiently strong to be tilted over into a vertical position after piling up of the core laminations.
Figure 5:
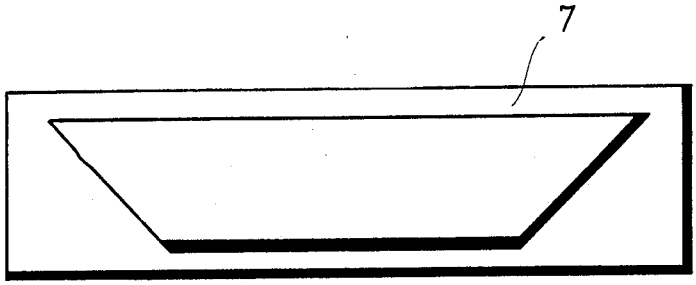
FIGS. 5 to 7 show the platforms on which the laminations of the columns and of the lower yoke are piled up in the reverse order to that used to build up the core.
Figure 6:
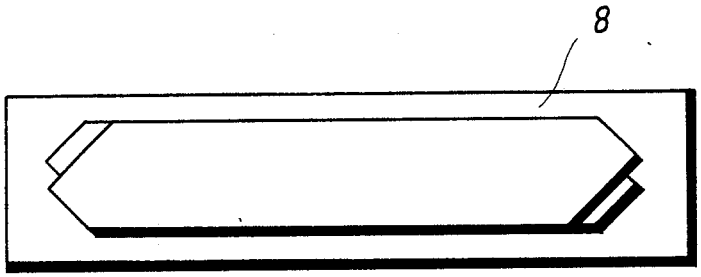
Figure 7:
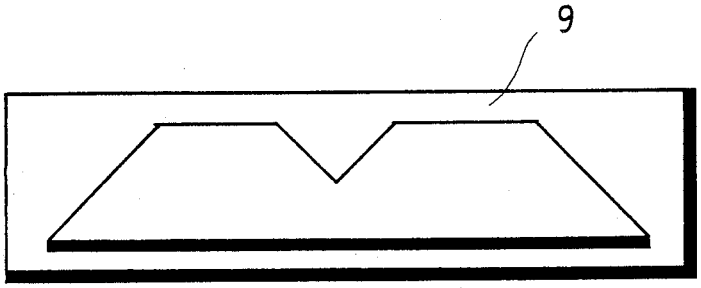

In addition to this, auxiliary trolleys 117 and 118 for small movements on a horizontal plane must allow, from time to time, positioning of the laminations according to the patterns illustrated in FIGS. 3 and 4.

The platforms 7, 8 and 9 must be able to travel from their working positions, alongside station (A), to loading positions, not shown in the figure, without interfering with their respective overhead traveling cranes 113/D, 113/S, 113/B and 113/A; they must therefore travel on independent rails.

FIG. 10 illustrates the guiding rails 119 located between the rails 112/D and referred to platform 7 for the right column.

The laminations are picked up one be one by the suction cup frame from the pile 102 arranged on platform 7; after which, in a second stage, the gantry crane 113/D moves over the position of the right column 2 of the transformer core, located on the supporting frame 10 positioned at station (A).

In this position, before placing the new lamination on top of the laminations of the right column already positioned on the frame 10, the auxiliary trolleys 117 and 118 are used to put the suspended lamination into its correct final position, staggered as called for by the arrangement shown in FIGS. 3 and 4.

In a third stage, the lamination is placed on the column 2 being built up; after this the frame 114 is raised and the gantry crane 113/D reverses.

Gantry crane 113/D can work at the same time as gantry crane 113/S, without interferences.

In other words, the laminations of the left and right columns may be positioned simultaneously, with symmetrical movements.

Below the loading station (A), with reference to FIG. 9, there is a third gantry crane 113/B used to load the laminations of the lower yoke 4 onto the supporting frame 10.

Its shape and movements are in every way similar to those of the overhead traveling cranes 113/D and 113/D, and it will therefore be equipped with guiding rails 112/B and will work in conjunction with the piling platform 9 containing the laminations for the lower yoke.

The shape of gantry crane 113/A, located above station (A) with reference to FIG. 9, is somewhat different. The guiding rails 112/A of this crane, in fact, are supported by a trolley 123 which can move transversally on auxiliary rails 124 perpendicular to the guiding rails 110 of the supporting frame 10.

In actual fact, the traveling crane 113/A behaves almost symmetrically to traveling crane 113/B; it differs from the latter in that it has a longer travel on the rails 112/A, since it must deposit the laminations of the central column between the two side columns, and must therefore move practically as far as the center of the frame 10.

In addition to this, the auxiliary trolley 123 will be moved in one direction or the other, transversally to the rails 110, along the rails 124, to leave a free path for the frame 10 as it moves from station (A) to station (B) after completion of the building up of the core laminations.

It is worthwhile to point out that each of the lifting frames 114 must carry out movements for lowering, raising, adjustment on a horizontal plane (to take into account the staggering of the laminations of the different layers), forwards and backwards in respect of the frame 10.

Only part of these movements interfere with the corresponding movements of the other frames 114, and therefore the movements of the various overhead traveling cranes can be programmed so that work is staggered from one crane to another, allowing them all to work continuously with a high productivity rate.

Obviously the movements of the overhead traveling cranes and of the auxiliary equipment will preferably be programmed and controlled by a dedicated computer; in addition, they will be fitted with positioning and control sensors capable of supplying said computer with the necessary input data.

What I claim is:

1. A transformer core assembly system for assembly of transformer laminated cores having three parallel legs and two yokes, the system comprising, a movable support frame on which individual transformer laminated cores are formed by stacking of core laminations thereon, the support frame being cyclically movable from a core lamination loading station after completion of a transformer laminated core thereon movable to another station for removal of a completed transformer laminated core thereon and then after removal of the completed transformer laminated core restored to the core lamination loading station, four individual movable platforms each having a stack of respective transformer core laminations thereon cyclically positioned at four individual lamination feed positions circumferentially about the support frame when the support frame is at said core lamination loading station and each movable independently cyclically from a respective lamination feed position in a selected sequence to an individual lamination loading position for loading of core laminations and when loaded with core laminations restored to the respective lamination feed position, four overhead travelling cranes cyclically operable independently in a selected sequence to said feed positions for feeding core laminations from a respective movable platform in a selected sequence on to the support frame for assemblying a transformer laminated core thereon and operable for loading laminations thereon when the respective platforms are at the respective lamination loading positions, and the four cranes having means for independently lifting and lowering the laminations individually for stacking thereof on the support frame and the corresponding platforms.

2. A transformer core assembly system for assembly of transformer laminated cores having three parallel legs and two yokes according to claim 1, including independent rails for the travelling cranes and said platforms.

3. A transformer core assembly system for assembly of transformer laminated cores having three parallel legs and two yokes according to claim 1, in which said means for lifting and lowering the individual laminations comprise a frame on a corresponding travelling crane having suction cups arranged for lifting the laminations individually and depositing them.

4. A transformer core assembly system for assembly of transformer laminated cores having three parallel legs and two yokes according to claim 3, including means for lifting and lowering said frame with the suction cups thereon.

5. A transformer core assembly system for assembly of transformer laminated cores having three parallel legs and two yokes according to claim 4, including means for moving the frame laterally relative to the corresponding crane thereby to provide for variable lateral positioning of the laminations.

6. A transformer core assembly system for assembly of transformer laminated cores having three parallel legs and two yokes according to claim 2, in which guide means are provided on a travelling crane associated with the support frame to guide it out of the path of the support frame when it is moved away from the lamination loading station.

7. A transformer core assembly system for assembly of transformer laminated cores having three parallel legs and two yokes according to claim 1, including control means and checking means comprising computer means for control of the travelling cranes.

8. A transformer core assembly system for assembly of transformer laminated cores, according to claim 7, including sensors for sensing the position of the movable platforms, support frame and travelling cranes for developing input electrical signals to the computer.

* * * * *